US008769714B2

(12) United States Patent
Meltzner

(10) Patent No.: US 8,769,714 B2
(45) Date of Patent: Jul. 8, 2014

(54) DIGIT TIP PROTECTION DEVICE

(76) Inventor: Steven D. Meltzner, Oklahoma City, OK (US)

( * ) Notice: Subject to any disclaimer, the term of this patent is extended or adjusted under 35 U.S.C. 154(b) by 165 days.

(21) Appl. No.: 13/272,658

(22) Filed: Oct. 13, 2011

(65) Prior Publication Data

US 2013/0091613 A1 Apr. 18, 2013

(51) Int. Cl.
*A41D 13/08* (2006.01)

(52) U.S. Cl.
USPC ..... 2/21

(58) Field of Classification Search
USPC ..... 2/21; 223/101; 294/25; 602/54
See application file for complete search history.

(56) References Cited

U.S. PATENT DOCUMENTS

| | | | | |
|---|---|---|---|---|
| 1,380,960 | A | 6/1921 | Hmenia | |
| 2,207,672 | A | 7/1940 | Levey | |
| 3,228,033 | A | 1/1966 | Ames et al. | |
| 3,511,242 | A | 5/1970 | Agnone | |
| 3,531,029 | A | 9/1970 | Lee | |
| D230,915 | S | 3/1974 | Fowler | |
| 4,102,480 | A | 7/1978 | O'Beirne-Ranelagh | |
| 4,694,508 | A | 9/1987 | Iriyama et al. | |
| 4,858,245 | A | 8/1989 | Sullivan et al. | |
| 4,864,661 | A | 9/1989 | Gimbel | |
| 4,873,998 | A | 10/1989 | Joyner | |
| 4,901,372 | A | 2/1990 | Pierce | |
| 4,942,626 | A | 7/1990 | Stern et al. | |
| 4,966,138 | A | 10/1990 | Chow et al. | |
| 4,985,038 | A | 1/1991 | Lyell | |
| 5,172,424 | A | 12/1992 | Adkins | |
| 5,500,957 | A * | 3/1996 | Stein | 2/169 |
| 5,547,465 | A * | 8/1996 | Powell | 602/54 |
| 6,098,854 | A | 8/2000 | Apple | |
| 6,175,962 | B1 | 1/2001 | Michelson | |
| 2004/0021330 | A1 * | 2/2004 | Percell | 294/25 |
| 2008/0018123 | A1 * | 1/2008 | Cox | 294/25 |
| 2009/0013441 | A1 | 1/2009 | Duffy | |
| 2013/0025016 | A1 * | 1/2013 | Koffi et al. | 2/21 |

FOREIGN PATENT DOCUMENTS

| | | |
|---|---|---|
| EP | 0609214 | 7/1992 |

* cited by examiner

*Primary Examiner* — Katherine Moran
(74) *Attorney, Agent, or Firm* — Dunlap Codding, P.C.

(57) ABSTRACT

A digit tip protection device comprises a concave puncture-resistant member adapted to protect a pulp of a user's digit. The puncture resistant material is thin and flexible to avoid interfering with the tactile sensation of the digit. The concave member has an adhesive layer adapted to adhere to the digit. The concave member has a first end extending over the pulp of the digit below the nail, a second end extending over the pulp of the digit below a first joint of the digit, and a lateral and medial edges extending along the digit. The digit tip protection device is adapted to be worn on a digit, such that the digit tip protection device substantially covers the pulp of the digit, and extends along the palmar surface of the digit below the distal interphalangeal joint. The adhesive layer may be covered with a protective layer of material.

3 Claims, 5 Drawing Sheets

DIGIT TIP PROTECTION DEVICE

CROSS-REFERENCE TO RELATED APPLICATIONS

Not applicable.

BACKGROUND

Surgeons, doctors, nurses, and other medical personnel often handle and/or work with sharp instruments which pose cut and puncture risks to the hands and arms of the person handling the sharp instruments. The prior art discloses several puncture-resistant protection devices to prevent punctures to the fingers and hands of medical personnel as they use sharp instruments. Such prior art devices are often bulky, do not conform to the shape of the user's digit, and extend over one or more of the joints of a user's digit. However, medical personnel, and surgeons in particular, usually need such protection devices to allow for normal range of motion, dexterity, and tactile sensation of the hand and digits, such that medical procedures requiring fine motor skills and precise movements are not negatively impacted by the protection device.

Further, due to the increased awareness of the medical community of blood borne and other infections diseases, such protection devices typically aim to protect a user not only from immediate physical injury, but also from becoming infected with a disease-causing agent, such as hepatitis, human immunodeficiency virus (HIV), bacterial infections, sexually-transmitted diseases (STDs), herpes, and other viral and bacterial agents and/or substances. Additionally, in some applications, the user's hands may also need to be protected from injury and from exposure to heat and/or chemical agents, such as acids, alkaline substances, medications including chemotherapy drugs, disinfectants, biocidal substances, corrosive agents, detergents, alcohols, and the like.

Medical gloves are well known in the art and are typically made of polymers such as latex, nitrile rubber, vinyl, and neoprene, or other similar barrier materials adapted to protect the user's hands from biological agents. Medical gloves include examination gloves and surgical gloves, which are typically sterile and manufactured to a higher standard than examination gloves. Such gloves, however, fail to provide sufficient puncture-resistance, and may be punctured and/or cut during medical procedures.

Therefore, a need exists in the prior art for a digit tip protection device which is capable of protecting the digit tip from punctures and cuts, while at the same time conforming to the shape of the user's digit and not extending over the joints of the digit to maintain as much of the natural dexterity and tactile sensation of the user's digit as possible. It is to such a digit tip protection device that the inventive concept disclosed herein is directed.

SUMMARY

In one version, the present disclosure describes a digit tip protection device having a concave member formed of a puncture resistant material adapted to protect a pulp of a user's digit from a puncture. In this version, the puncture resistant material is sufficiently thin and flexible to avoid interfering with a natural tactile sensation of the user's digit. The concave member is provided with a concave surface comprising an adhesive layer adapted to adhere to a pulp of a user's digit, a convex surface opposite the concave surface; a first end adapted to extend distally over the pulp of the user's digit below a user's nail; a second end adapted to extend proximally over the pulp of the user's digit below a first distal interphalangeal joint of the user's digit; lateral and medial edges adapted to extend along the user's digit; and a protective layer of material covering the adhesive layer and removable therefrom. The digit tip protection device is adapted to be worn on a user's digit, such that the digit tip protection device substantially covers the pulp of the user's digit, extends along the palmar surface of the user's digit below the distal interphalangeal joint.

In another version, a protection assembly is described. The protection assembly includes a digit tip protection device as described above, and a glove comprising a biological barrier and worn over the concave member on the user's hand.

In yet another version, a kit including a plurality of digit tip protection devices is described.

In one version, the protective layer of material of the digit tip protection device is removable from the adhesive layer without destroying at least one of the protective layer of material and the concave member. The puncture-resistant material of the digit tip protection device comprises a resilient polymer material.

The digit tip protection device may be adapted to be worn under a glove, such as a surgical glove or examination glove.

The digit tip protection device may be made by forming a concave member of a puncture resistant material adapted to protect a pulp of a user's digit from a puncture and being sufficiently thin and flexible to avoid interfering with a natural tactile sensation of the user's digit upon application of the concave member onto the user's digit. The concave member may comprise a concave surface, a convex surface opposite the concave surface, a first end adapted to extend distally over the pulp of the user's digit below a tip of a user's nail, a second end adapted to extend proximally over the pulp of the user's digit below a first distal interphalangeal joint of the user's digit, and lateral and medial edges adapted to extend along the user's digit. An adhesive may be applied to the concave surface and a protective layer of material may be applied over the adhesive layer.

BRIEF DESCRIPTION OF THE SEVERAL VIEWS OF THE DRAWINGS

So that the above recited features and advantages of the present inventive concept can be understood in detail, a more particular description of the inventive concept, briefly summarized above, may be had by reference to the embodiments thereof that are illustrated in the appended drawings. It is to be noted, however, that the appended drawings illustrate only typical embodiments of the inventive concept and are therefore not to be considered limiting of its scope, for the inventive concept may admit to other equally effective embodiments. The appended drawings are not necessarily to scale, and certain features and views of the drawings may be shown exaggerated in scale or in schematic, in the interest of clarity and conciseness.

DETAILED DESCRIPTION

Figure 1:
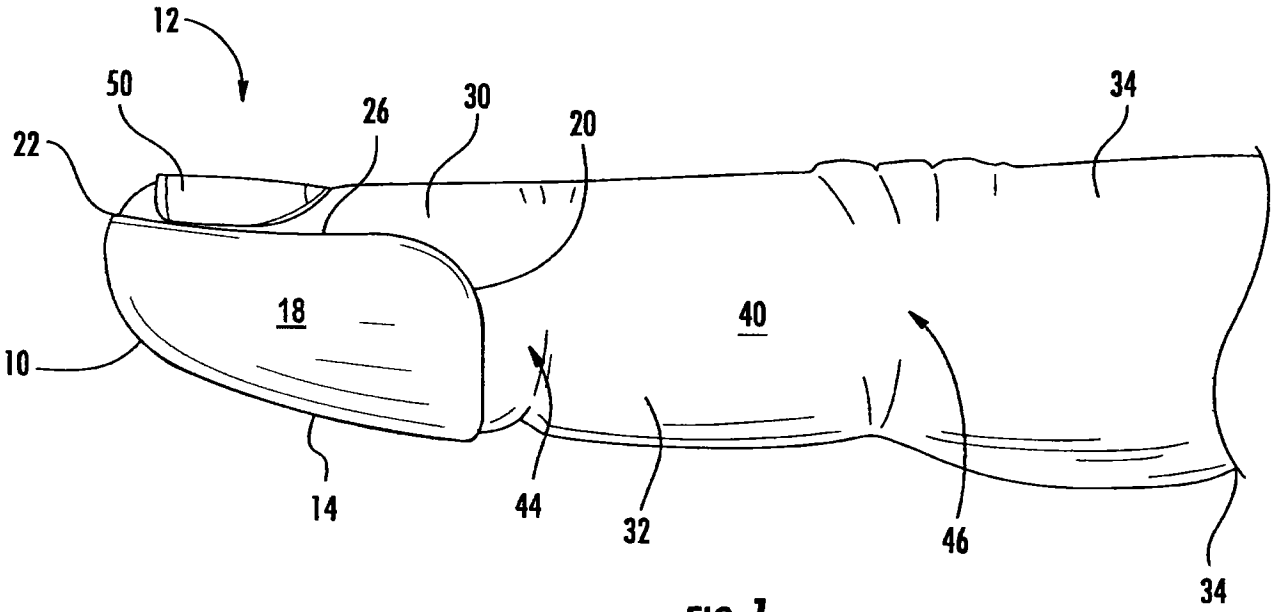
FIG. 1 is a perspective view of a digit tip protection device positioned onto a user's digit according to the instant disclosure.

Before explaining at least one embodiment of the inventive concept disclosed herein in detail, it is to be understood that the inventive concept is not limited in its application to the details of construction and the arrangement of the components or steps or methodologies set forth in the following description or illustrated in the drawings. The inventive concept disclosed herein is capable of other embodiments or of being practiced or carried out in various ways. Also, it is to be understood that the phraseology and terminology employed herein is for the purpose of description and should not be regarded as limiting in any way.

In the following detailed description of embodiments of the disclosure, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

The inventive concept disclosed herein is generally related to a digit tip protection device. More particularly, but not by way of limitation, the inventive concept disclosed herein is directed to a concave digit tip protection device to be attached to a digit tip's pulp via an adhesive.

As is known by persons of ordinary skill in the art, established human anatomical orientation designations are used to avoid ambiguities when referring to a body part relative to another body part. A standard anatomical position (i.e., standing upright facing forward with arms to the side, palms facing forward, thumbs pointing laterally away from the body) has been established, and such orientation designations refer to the various body parts in the standard position, without regard to their actual position. For the purposes of the instant disclosure such standard human anatomy terminology will be used to describe the various orientation and interrelationships of the different parts of a user's body. More particularly, as used herein:

"Proximal" shall be understood to mean where the appendage (any portion separate from the main body) joins the main body. For example, moving from a fingertip towards a wrist would be moving in a proximal direction.

"Distal" shall be understood to mean furthest from the point of attachment to the body. For example moving from a forearm towards a fingertip would be moving in a distal direction.

"Lateral" shall be understood to mean away from a central line of the body. For example, in the standard anatomical position, the thumbs extend laterally from the body.

"Median" shall be understood to mean towards a central line of the body. For example, in the standard anatomical position, the little finger is median to the thumb.

"Palmar" shall be understood to mean the palm side of the hand, including the palm and the surfaces of the thumb and fingers.

"Dorsal" shall be understood to mean the back side of the hand, including the back of the hand and the back surfaces of the thumb and fingers.

"Pulp" shall be understood to mean the fleshy part on the palmar surface of the tip of a digit (thumb or a finger), which generally extends to the first interphalangeal joint. The terms digit tip and digit pad may be used interchangeably herein to refer to the pulp.

Phalanx (plural phalanges) shall be understood to not only mean a bone of a digit (finger or thumb) of a user but to also include the relevant portion of a digit of a user. For example, the distal phalanges would be the digit tips, the intermediate phalanges would be portions of the digits between the first and second joints, and proximal phalanges would be the portions of the digits adjacent to the palm.

"Distal interphalangeal joint" shall be understood to mean the joint connecting the distal and intermediate phalanges.

"Proximal interphalangeal joint" shall be understood to mean the joint connecting the intermediate and proximal phalanges.

Referring now to FIG. 1, shown therein is an exemplary embodiment of a digit tip protection device 10 attached to a user's digit 12. The digit tip protection device 10 comprises a concave member 14, which has a concave surface 16, a convex surface 18, a proximal end 20, a distal end 22, a lateral edge 24, and a median edge 26.

Figure 2C:
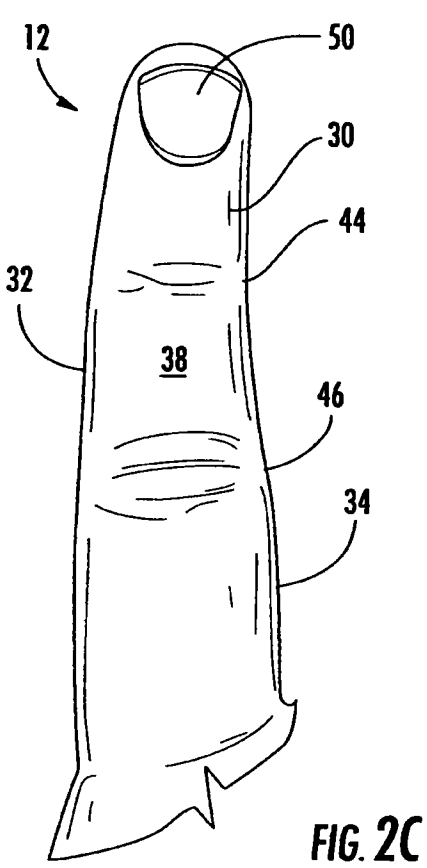
FIG. 2C is a perspective view of the user's digit shown in FIG. 1, showing the dorsal side of the digit.
Figure 2A:
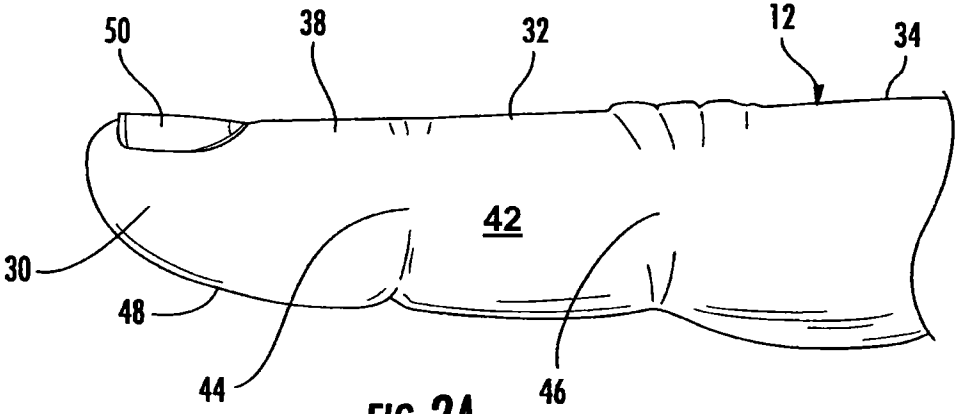
FIG. 2A is a perspective view of the user's digit shown in FIG. 1, showing the lateral side of the digit.
Figure 2B:
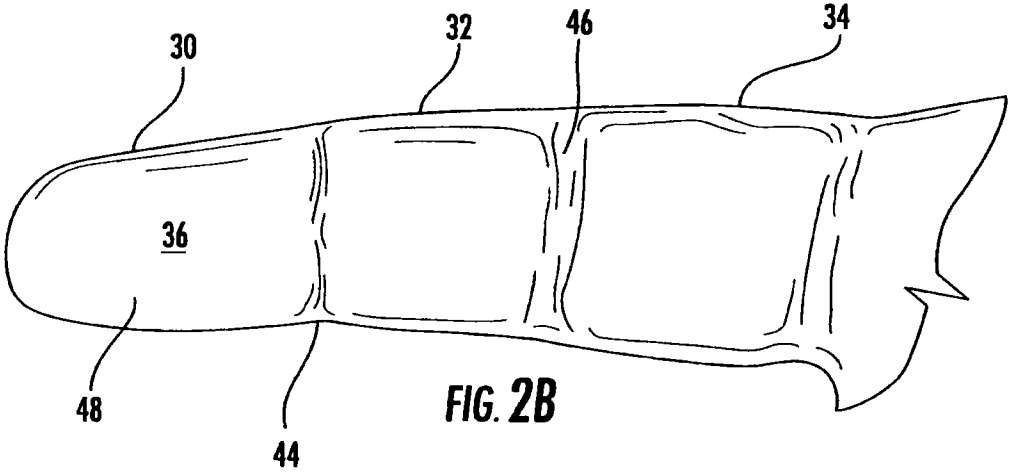
FIG. 2B is a perspective view of the user's digit shown in FIG. 1 showing the palmar side of the digit.

Referring now to FIGS. 2A-2C shown therein is a user's digit 12. The user's digit 12 is shown as a right index finger, but it is to be understood that any digit 12 may be used with the inventive concept disclosed herein, including a thumb, an index finger, a middle finger, a ring finger, and a little finger, whether on the right or left hand, as will be understood by persons of ordinary skill in the art. Additionally, a digit tip protection device 10 according to the instant inventive concept may be used with toes, heel, and/or certain portion of a user's palm, hand, and forearm, for example.

The digit 12 preferably comprises a distal phalanx 30, an intermediate phalanx 32, and a proximal phalanx 34. The digit 12 also preferably comprises a palmar side 36, a dorsal side 38, a lateral side 40, and a median side 42, said side designations relating to the standard anatomical position. The distal phalanx 30 and the intermediate phalanx 32 are pivotally attached via a distal interphalangeal joint 44. The intermediate phalanx 32 is pivotally attached to the proximal phalanx 34 via a proximal interphalangeal joint 46.

The distal phalanx 30 comprises a pulp 48 disposed on the palmar side 36 thereof, and a nail 50 disposed on the dorsal side 38 thereof. The pulp 48 extends over the palmar side 36 of the distal phalanx 30 and is preferably at least partially defined by the distal interphalangeal joint 44.

Figure 3B:
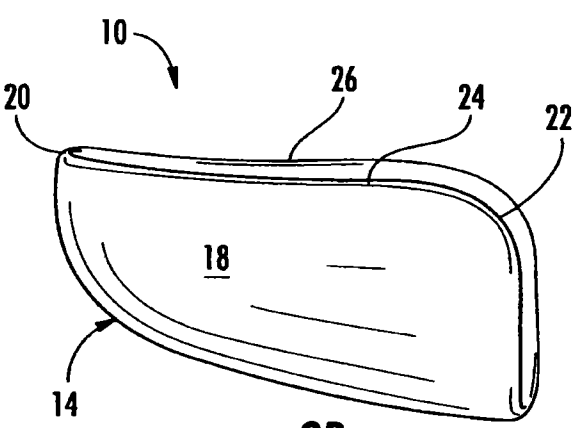
FIG. 3B is a side view of the digit tip protection device of FIG. 3A.
Figure 3A:
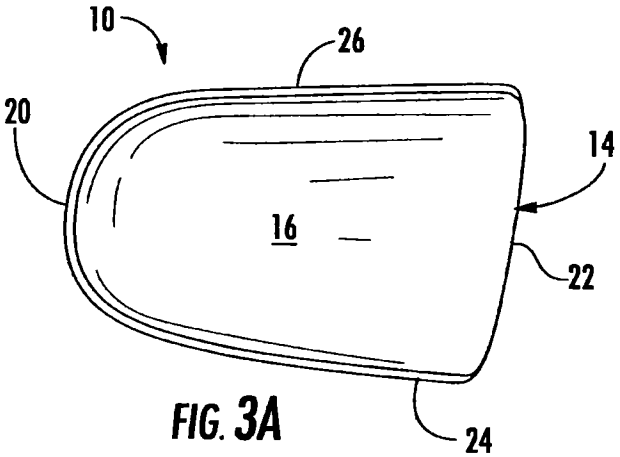
FIG. 3A is a top view of the digit tip protection device according to the instant disclosure.
Figure 3C:
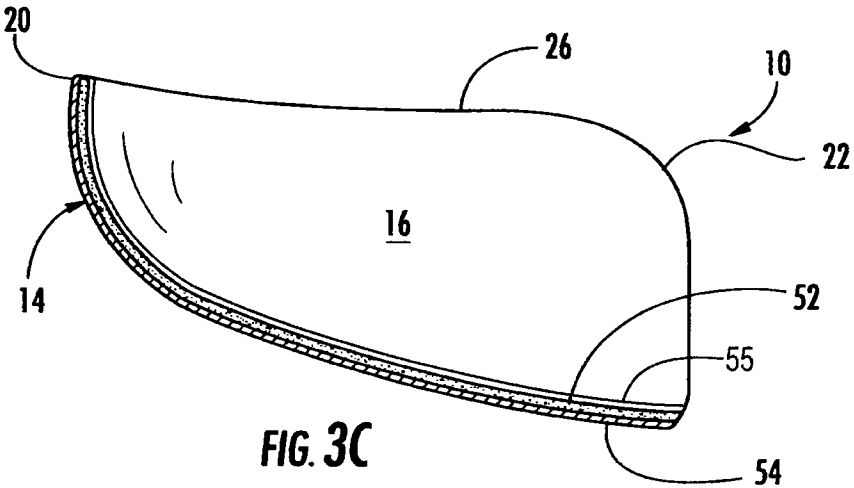
FIG. 3C is a cross-sectional side view of the digit tip protection device of FIG. 3A.

Referring now to FIGS. 3A-3C, shown therein is an embodiment of a digit tip protection device 10 according to the instant inventive concept. The digit tip protection device 10 comprises a concave member 14 that is shaped in the following manner before application of the concave member 14 to the user's digit 12. The concave member 14 comprises a concave surface 16, a convex surface 18, a proximal end 20, a distal end 22, a lateral edge 24, and a median edge 26 when the digit tip protection device 10 is not attached to the user's digit 12. The concave member 14 may be made of any suitable material having puncture resistance and flexibility, such as resilient polymer materials, for example. It is to be understood that the concave member 14 may comprise a single layer of material, or may comprises two or more layers bonded or otherwise joined together to form the concave member 14, for example. The concave member 14 may be produced in a variety of sizes to accommodate differently sized digits 12, as will be understood by persons of ordinary skill in the art presented with the instant disclosure. The concave member 14 is adapted to conform to the shape and curvature of the user's digit 12, such that the natural tactile sensation of the digit 12 is not adversely impacted by the attachment of the concave member 14. Further, the concave member 14 may be impregnated with a variety of chemical substances, such as biocidal agents and/or disinfectants, for example.

The concave surface 16 preferably comprises an adhesive layer 52 (FIG. 3C) adapted to attach the concave member 14 to the pulp 48. The adhesive layer 52 may comprise any suitable low-strength adhesive which allows the digit tip protection device 10 to be easily removed after use without destruction of the concave member 14, or the use of solvents to degrade the adhesive or the like. The concave surface 16 is adapted to receive the pulp 48 of a user's digit 12 therein, such that the pulp 48 is directly in contact with the adhesive layer 52 of the concave surface 16. The adhesive layer 52 is adapted to removably attach the concave surface 16 to the pulp 48. Preferably, the adhesive layer 52 is adapted to allow for the detachment of the pulp 48 from the concave surface 16 when a sufficient force is applied by a user, while at the same time securely retaining the pulp 48 against the concave surface 16 such that the digit tip protection device 10 remains in place during use. Such retention may be further enhanced by the use of the digit tip protection device 10 in combination with a glove as will be described with reference to FIG. 5 below. Optionally, a layer of protective material 55 may be positioned onto the adhesive layer 52 and removed prior to the application of the digit tip protection device 10 onto the user's digit 12. The layer of protective material 55 may comprise wax paper, plastic, metal foil, protective polymer, and combinations thereof, for example. Additionally, the digit tip protection device 10 may be packaged into a package, which may optionally be sterile, for example.

The convex surface 18 preferably comprises a puncture-resistant layer 54 (FIG. 3C), which puncture-resistant layer 54 may optionally comprise grip-enhancing features (not shown), such as grooves, indentations, striations, or bumps, for example. The puncture-resistant layer preferably comprises resilient polymer material, which is at the same time flexible and elastomeric, such that is protects the pulp 48 from punctures, while at the same time preserving maximum tactile sensation in the pulp 48. The proximal end 20 is adapted to cover the pulp 48 of a user's digit 12. Preferably, the concave member 14 is sized such that the proximal end 20 extends just below (i.e. distally from) the distal interphalangeal joint 44. Similarly, the distal end 22 is adapted to cover the pulp 48 of a user's digit 12, and is preferably sized such that the distal end extends just below the nail 50. Such arrangement and sizing of the digit tip protection device 10 ensures that the natural range of motion of the digit 12 is not inhibited by the digit tip protection device 10.

The lateral edge 24 and the median edge 26 preferably cover the pulp 48 of the digit 12. The lateral edge 24 and the median edge 26 are preferably sized such that when the concave member 14 is attached to a digit 12, the lateral edge 24 extends partially over the lateral side 40, and the median edge 26 extends at least partially over the median side 42 of the digit 12, but such that the lateral edge 24 and the median edge 26 do not extend to the dorsal side 38 of the digit 12. It is to be understood however that in an exemplary embodiment, the lateral edge 24, and the median edge 26 may extend only partially over the dorsal side 38 of the digit 12.

Figure 4:
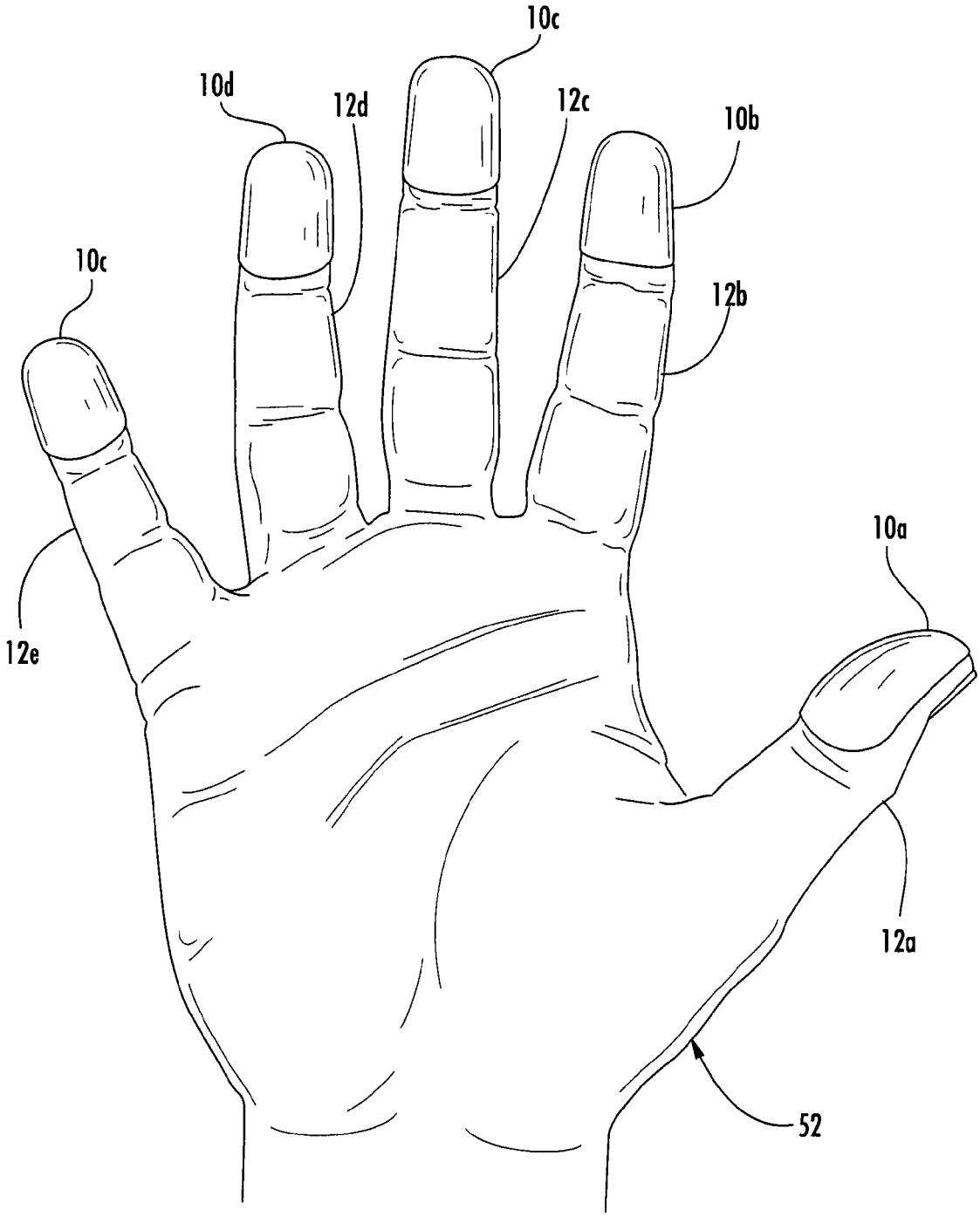
FIG. 4 is a perspective view of an embodiment comprising a plurality of digit tip protection devices positioned onto a user's digits according to the instant disclosure.

Referring now to FIG. 4, shown therein is an exemplary embodiment of the inventive concept disclosed herein comprising a plurality of digit tip protection devices 10*a-e* attached to a plurality of digits 12*a-e*. It is to be understood that while five digits 12*a-e* on a user's right hand 56 are shown as having a digit tip protection device 10*a-e* attached thereto, none, only one, two, three, and/or four of the digits 12*a-e* may have a digit tip protection device 10*a-e* attached thereto, for example. Further, a digit tip protection device 10*a-e* may be attached to any of the digits 12 of a user, including toes, fingers, and thumbs, as will be understood by a person of ordinary skill in the art presented with the instant disclosure.

Figure 5:
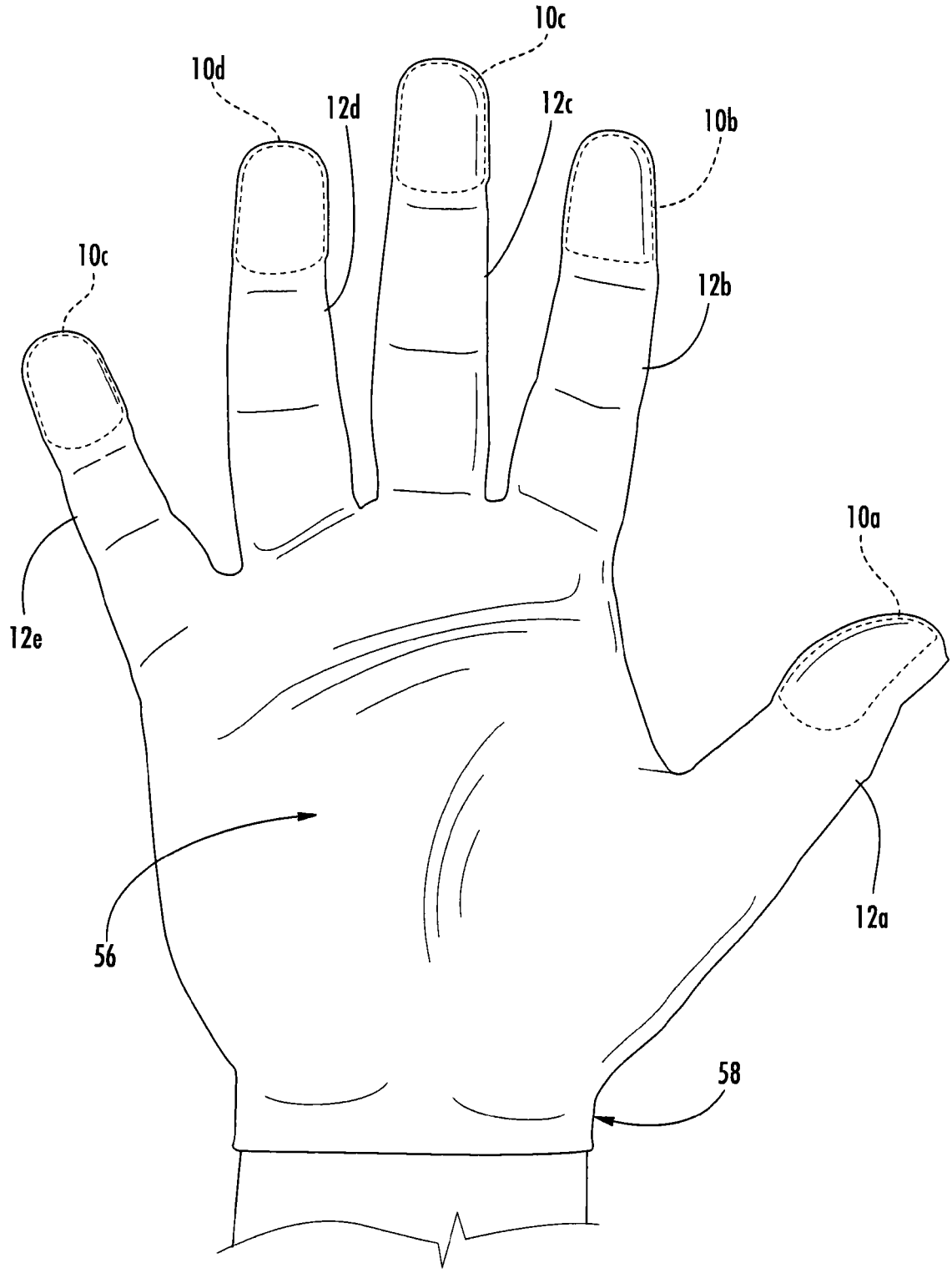
FIG. 5 is a perspective view of a digit protection device positioned onto a user's digit under a glove according to an exemplary embodiment of the inventive concept disclosed herein.

Referring now to FIG. 5, shown therein is an exemplary embodiment of the instant disclosure wherein a plurality of digit tip protection devices 10*a-e* are shown (in phantom) attached to a plurality of digits 12*a-e*, and a glove 58 is placed on the user's right hand 56. It is to be understood that such combination may allow medical personnel to replace the glove 58 without replacing the digit tip protection devices 10*a-e* as will be appreciated by persons of ordinary skill in the art. Further it is to be understood that while five digits 12*a-e* on a user's right hand 56 are shown as having a digit tip protection device 10*a-e* attached thereto, none, only one, two, three, of four of the digits 12*a-e* may have a digit tip protection device 10*a-e* attached thereto, for example. Further, a digit tip protection device 10*a-e* may be attached to any of the digits 12 of a user, including toes, fingers, and thumbs, as will be understood by a person of ordinary skill in the art presented with the instant disclosure.

The glove 58 may be any conventional glove known in the art, and may comprise an examination glove, a surgical glove, a chemically-resistant glove, and combinations thereof, for example. The glove 58 can be made of any conventional material, such as latex rubber, nitrile rubber, polyethylene, nylon, and other suitable polymers, for example. Further, the glove 58 may be coated and/or impregnated with various biocidal, chemical, or disinfecting agents, for example. The glove 58 may further be coated with a powder, such as a latex powder, for example, to absorb moisture from the user's hands and to facilitate putting the glove 58 on and taking the glove 58 off by a user. The glove 58 preferably comprises a biological barrier (e.g., prevents one or more biological agents such as bacteria and/or viruses from crossing through the glove 58). In an exemplary embodiment, the glove 58 further comprises a chemical barrier (e.g., prevents one or more chemicals from crossing through the glove 58).

In use, a user may select the appropriate size and number of digit tip protection devices 10 to apply to his or her digits 12. The user may first wash and dry their hands in accordance with any applicable infection control policies and/or procedures. Next, the user may remove the digit tip protection device 10 from its packaging, if any. Next, the protective layer of material may be removed to expose the adhesive layer 52. The user then applies the digit tip protective device 10 over the pulp 48 of the selected digit 12, and secures the digit tip protection device 10 onto the pulp 48, such as by briefly applying pressure onto the digit tip protection device 10 to ensure the adhesive layer 52 contacts and adheres to the pulp 48. Next, the user may apply one or more additional digit tip protection devices to one or more of the remaining digits 12 of the user. Then, one or more glove 58 may be placed on the user's hand, which glove 58 may have different properties depending on the particular procedure the user is about to undertake, as described above. For example, an examination glove 58*a* may be placed on the user's hand, and a chemically resistant glove 58*b* may be placed on the user's hand on top of the examination glove 58*a*. As another example, two or more surgical and/or examination gloves 58*a-n*, may be successively placed on the same hand of a user, i.e. colloquially known as "double-gloving."

It is to be understood that the inventive concept disclosed herein is not limited to protecting only digits, and a protection device according to the instant disclosure may be applied to a user's digits, toes, palms, soles of feet, heels, elbows, forearms, and combinations thereof, for example. Further, a protection device according to the instant inventive concept is not limited in its application to the palmar surface of the hand and digits, and may be applied to the dorsal surface, lateral surface, medial surface, palmar surface, and combinations thereof, as will be understood by persons of ordinary skill in the art presented with the instant disclosure.

While the digit tip protection device 10 has been described in a medical application herein, it is to be understood that the instant inventive concept is not limited to medical application. As will be appreciated by a person of ordinary skill in the art, a digit tip protection device 10 according to the instant inventive concept may be used in dentistry, industrial applications, and other applications where digit tip injury dangers are present and/or high dexterity and near-natural tactile sensation are beneficial, for example. Exemplary implementations of a digit tip protection device according to the instant inventive concept include, but are not limited to, working with rotary or other power tools such as drills or abrasive tools, soldering, welding, sewing, knitting, sharpening tools, grinding, machining or molding high-precision parts and components, tattooing, body piercing, dentistry, veterinary medicine, woodworking, metal processing such as engraving and etching, jewelry production and repair, and other similar settings, for example.

Further, a digit tip protection device according to the instant inventive concept may be utilized in certain law enforcement, military, firefighting, and disaster assistance applications, such as discharging, cleaning, and/or servicing weapons, handling hot weapons, frisking suspects, processing crime scenes, rescuing trapped individuals from wrecked vehicles and/or from collapsed of burning buildings, providing first aid to victims, and combinations thereof, for example. In such applications, additional layers may optionally be added to a digit tip protection device, such as antimicrobial and/or biocidal layers, heat-resistant layers, chemical-resistant layers, and combinations thereof, for example.

From the above description it is clear that the inventive concept disclosed herein is well adapted to carry out the objects and to attain the advantages mentioned herein as well as those inherent in the inventive concept. While presently preferred embodiments of the inventive concept have been described for purposes of this disclosure, it will be understood that numerous changes may be made which will readily suggest themselves to those skilled in the art and which are accomplished within the scope of the inventive concept disclosed and as defined in the appended claims.

What is claimed is:

1. A protection assembly, comprising:

a digit tip protection device having a concave member adapted to be positioned on a pulp of a user's digit, the concave member comprising a puncture resistant material adapted to protect the pulp from a puncture and being sufficiently thin and flexible to avoid interfering with a natural tactile sensation of the user's digit, the concave member comprising:

a concave surface comprising an adhesive layer adapted to adhere to the pulp of the user's digit;

a convex surface opposite the concave surface;

a first end adapted to extend distally over the pulp of the user's digit to below a tip of a user's nail;

a second end adapted to extend proximally over the pulp of the user's digit to below a first distal interphalangeal joint of the user's digit;

lateral and medial edges adapted to extend along the user's digit; and wherein the digit tip protection device is adapted to be removably attached to the pulp of the user's digit, such that the digit tip protection device substantially covers the pulp of the user's digit, and the second end extends along a palmar surface of the user's digit below the distal interphalangeal joint; and a glove comprising a biological barrier and worn over the concave member on the user's hand.

2. The protection assembly of claim 1, wherein the glove is a surgical glove.

3. The protection assembly of claim 1 wherein the glove is an examination glove.

* * * * *